United States Patent [19]

Platts

[11] 4,455,092

[45] Jun. 19, 1984

[54] MIXING APPARATUS

[75] Inventor: Stanley A. Platts, Warley, England

[73] Assignee: Unishear Mixers Limited, Tipton, England

[21] Appl. No.: 391,926

[22] Filed: Jun. 24, 1982

[30] Foreign Application Priority Data

Jul. 2, 1981 [GB] United Kingdom ..... 8120541

[51] Int. Cl.[3] ..... B01F 7/04

[52] U.S. Cl. ..... 366/305; 366/306; 366/307; 415/121 B

[58] Field of Search ..... 366/302, 305, 306, 307, 366/325, 329, 264, 176, 178; 241/46 R, 46.11, 46.17, 46.06, 74, 154; 415/121 B

[56] References Cited

U.S. PATENT DOCUMENTS

| | | | |
|---|---|---|---|
| 2,578,274 | 12/1951 | Weigham et al. | 241/46.11 |
| 2,578,805 | 12/1951 | Johnson | 366/264 X |
| 2,846,152 | 8/1958 | Brophy | 241/46.11 X |
| 3,599,881 | 8/1971 | Craig | 241/46.06 |
| 3,620,460 | 11/1971 | Hankes | 241/46.11 |
| 3,671,019 | 6/1972 | Tapscott et al. | 366/307 |
| 3,982,700 | 9/1976 | Love | 241/46.11 |

*Primary Examiner*—Philip R. Coe

*Attorney, Agent, or Firm*—Holman & Stern

[57] ABSTRACT

A mixing apparatus has a housing containing a pair of apertured stators permitting flow therethrough respectively in different directions, and a bladed rotor having first and second rotor blades each cooperating with a respective stator. Rotation of the rotor blades forces material to be mixed through the stators and, because of the arrangement of the rotor blades relative to the stator apertures, produces a shearing action on the material in two different non-parallel planes.

9 Claims, 2 Drawing Figures

MIXING APPARATUS

BACKGROUND OF THE INVENTION

Field of the Invention

This invention relates to multi-purpose mixing apparatus for mixing together materials in liquid and solid form and primarily for breaking down and mixing solid material with liquid. An object of the invention is to provide an apparatus of more compact dimensions relative to its mixing capacity and of increased efficiency as compared with some conventional apparatus.

BRIEF SUMMARY OF THE INVENTION

According to the present invention, a mixing apparatus comprises a housing having a material inlet and outlet and containing a pair of apertured stators, the apertures of each of which respectively permit fluid flow therethrough in different directions, and a bladed rotor arranged with first and second bladed parts thereof respectively in co-operative relationship with the stators, whereby rotation of the rotor forces material introduced through the inlet successively through the stators and in so doing, by co-operation of the blades and stator apertures, subjects said material to shearing actions in different non-parallel planes.

In one convenient arrangement, one of the stators has a cylindrical apertured wall closely surrounding a first bladed part of the rotor, the apertures being arranged so that rotation of the rotor brings said first bladed part into co-operation with said apertures successively.

One of the stators may conveniently be a flat plate extending generally perpendicularly to the rotational axis of the rotor and co-operating with a second bladed part of the rotor. The plate is preferably arranged to divide the housing into two chambers, each containing a respective one of said rotor parts each for co-operation with one of the stators, said chambers communicating respectively with the inlet and outlet.

The rotor portions may conveniently be mounted on a common drive shaft and are preferably carried on opposite sides of a common support driven by the shaft.

BRIEF DESCRIPTION OF THE DRAWINGS

The invention will now be described, by way of example, with reference to the accompanying drawings wherein.

DETAILED DESCRIPTION

Figure 1:
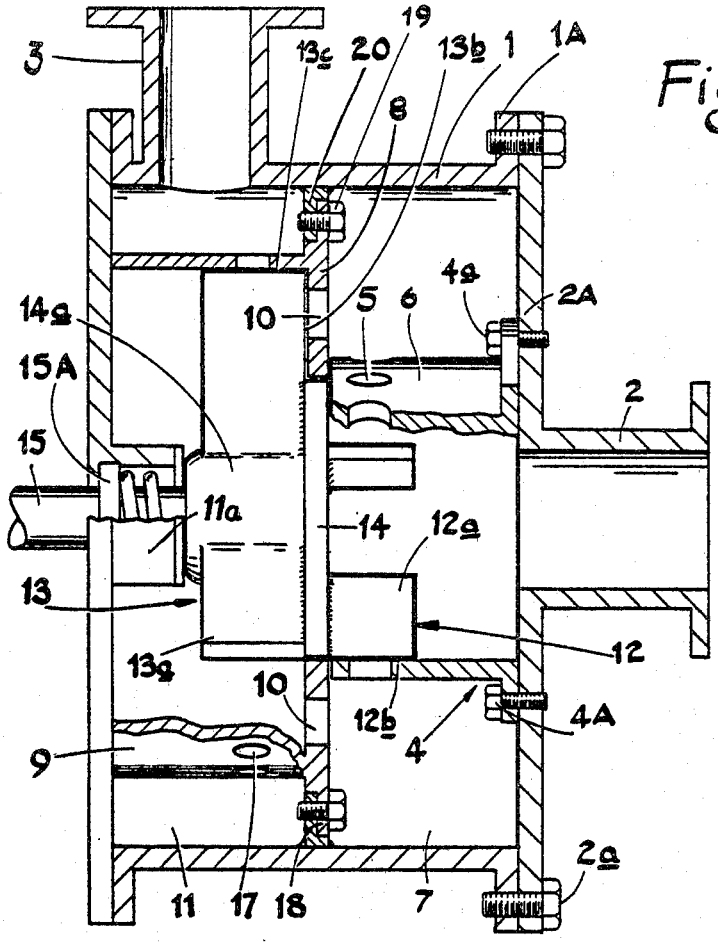
FIG. 1 is a side elevational view, partly in longitudinal cross-section and partly broken away for clarity of illustration, of the mixing apparatus of the invention.

The mixing apparatus shown in FIG. 1 comprises a generally cylindrical housing 1 having an inlet 2 and an outlet 3 directed in mutually perpendicular directions. The inlet 2 is formed in an end cover 2A secured to a radially outward flange 1A of the housing by bolts 2*a*. The housing contains a first cylindrical stator 4 secured to the cover 2A around the inlet 2 by bolts 4*a* passing through a radially outward flange 4A of the stator around the inlet 2 and having a series of radial holes 5 through its circumferential wall 6, opening into a first chamber 7. A second stator is in the form of an apertured flat plate 8 formed as a radially inward flange on a further cylindrical stator 9 which will be further described hereinafter. The plate 8 extends at right angles to the circumferential wall 6 of the stator 4, the apertures 10 of the plate 8 being arranged in a circular formation surrounding the stator 4. These apertures 10 provide communication between the chamber 7 and a second chamber 11 formed at the opposite side of the plate 8 to the first chamber 7 and communicating with the outlet 3, the chamber 11 containing the further stator 9.

The housing 1 contains a rotor having two sets of blades 12, 13 disposed respectively at either side of the plate 8. As can be seen more clearly from FIG. 2, the rotor blades in this embodiment, share a common support in the form of a central plate 14, to opposite sides of which the blades 12*a*, 13*a* respectively of the sets 12 and 13 are secured, as by welding for example. The radially innermost edges of the blades 13*a* are secured to an axial boss 14*a* projecting from a central region of the appropriate side of the plate 14. The rotors are driven in rotation from a motor (not shown) by a shaft 15 drivingly connected to the boss 14*a* by a key or other suitable means (not shown). The plate 14 lies within a central aperture of the stator plate 8 so as to lie substantially co-planar with the latter and a spring-loaded seal 15A acts between the shaft 15 and an axially directed flange 11*a* of the casing in order to prevent leakage of material outwardly along the shaft.

Figure 2:
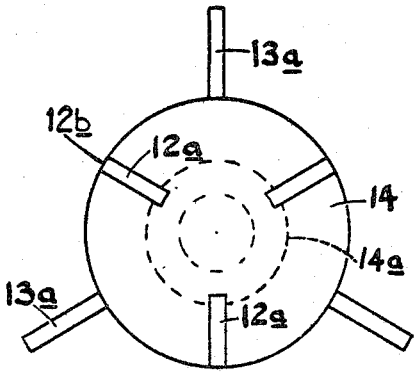
FIG. 2 is an end elevational view of part of the apparatus of FIG. 1.

As can be seen from FIG. 2, the blades 12*a* extend radially outwardly from locations spaced from the center of the plate 14, to the peripheral extremity of the plate and their outermost radially extending edges 12*b* lie in close proximity to the inner surface of the stator wall 6 and thus to the edges of the apertures 5, their axial extent being such that they span the apertures 5. The blades 13*a* extend radially outwardly of the plate 14 by a distance greater than the radially outermost extent of the apertures 10 of the stator plate 8. The edges 13*b* of the blades 13*a* closest to the plate 8 thus lie in close proximity to the adjacent surface of the plate 8 and their rotational path is very close to the peripheral edges of the apertures 10 of that plate.

The further apertured stator 9 referred to above is similar in form to the cylindrical stator 4 and of diameter such as closely to surround the radially outermost edges 13*c* of the blades 13*a*. The stator 9 has an annular row of apertures 17 disposed at an axial location such as to lie along the rotational path of said blade edges 13*c*. A peripheral outwardly directed radial flange 18 of the stator 9 is secured, as by bolts 19, to an internal inwardly directed radial flange 20 of the housing which is recessed to facilitate location of the stator. A radially inwardly directed flange of the stator 9 forms the apertured stator plate 8 and extends into close proximity with the central plate 14 of the rotor. It will be seen that by removing the end cover 2A of the housing, which removes also the stator 4, access is provided to the bolts 19, the removal of which then enables the stator 9 to be withdrawn axially without disturbing the rotor. This provides the advantage of facilitating assembly of the apparatus in production, and dismantling the stators for cleaning or repair or in order to substitute stators having different numbers, sizes, shapes and arrangements of apertures. Such characteristics may thus be readily changed as desired according to the type of material to be mixed and the degree of breakdown of solids required. For example, square or triangular apertures increase the shearing action by virtue of their increased useful peripheral edges and multiple rows of apertures may be employed in or to increase the action even further.

In order to prepare the apparatus for use, it is desirable to remove as much air as possible from within the housing 1 and this is achieved by priming the housing with a suitable liquid, such as water, the air being expelled through drain taps (not shown) opened for the purpose and subsequently closed. With the rotors driven in rotation, a mixing operation can then be performed by feeding material to be mixed via the inlet 2 into the interior of the stator 4, such material being urged radially outwardly towards and through the stator apertures 5 by rotation of the blades 12*a*. The outer edges of the blades 12*a* move in close proximity to the peripheral edges of the apertures 5 and as the material, which may be a mixture of lumpy solids and a liquid, is expelled through these apertures, a shearing action takes place between the aforesaid edges of the blades and apertures, which breaks down the solid lumps to enhance mixing thereof with the liquid.

The material passing through the stator 4 enters the chamber 7 and creates an over-pressure in this chamber which tends to force the material to pass through the apertures 10 of the stator plate 8. Rotation of the blades 13*a* assists in drawing material through these apertures and a second shearing action then takes place between the peripheral edges of the apertures 10 and the closely adjacent edges 13*b* of the rotating blades 13*a*. This results in a more finely divided and thoroughly mixed material being introduced into the interior of the stator 9 whence, under the action of the rotating blades 13*a* and an over-pressure created within this stator, the material is ejected through the apertures 17 and is subjected to a further shearing action between the radially outermost edges 13*c* of the blades 13*a* and the peripheral edges of the apertures 17. This action produces an even finer breakdown of the solid material and more thorough mixing thereof with the liquid, the mixture leaving the apertures 17 entering the chamber 11 and thereby producing an over-pressure in that chamber, causing the mixture to be expelled from the outlet 3.

The apparatus described may be used to mix material fed from a tank and the mixed material can either be recirculated to the tank from the outlet 3 or conducted by suitable piping from the outlet to a desired location. Alternatively, material to be mixed may be fed under metered conditions into the inlet 2 so that a known quantity may be discharged, as for example into a tanker for subsequent delivery. The apparatus may alternatively be connected into a pipeline in order to treat material flowing along such pipeline.

It will be appreciated that the different shear planes may be achieved bu using separate blades for co-operation respectively with a pair of stators, as exemplified by the stators 4 and 8 and the blades 12*a* and 13*a*; alternatively, the different shearing planes may be obtained by using different edges of the blades of a single rotor to co-operate respectively with a pair of stators, as exemplified by the blades 13*a* and their edges 13*b* and 13*c* co-operating respectively with the stator plate 8 and stator 16. The numbers and shapes of blade in each rotor may be varied as desired, as may be the sizes and shapes of the various stator apertures. The apparatus of the invention is of compact dimensions but nevertheless provides a thorough and effective mixing action on a wide variety of solids in liquids and can have a greater compactness relative to its mixing effectiveness than some conventional mixers.

Although for reasons of compactness and simplicity it is convenient for the rotor to have first and second bladed parts which are rigidly interconnected and driven by a common shaft as described, it will be understood that the rotor may comprise separate independently rotatable parts, which could be driven, for example by a pair of drive shafts conveniently arranged coaxially one within the other, or alternatively extending separately into the housing from the same or different directions.

I claim:

1. A mixing apparatus comprising a hollow housing, a first plate stator mounted within said housing dividing the interior thereof into a first chamber and a second chamber, a material inlet through said housing communicating with said first chamber, a material outlet through said housing communicating with said second chamber, apertures through said first stator through which said chambers communicate, a second hollow cylindrically shaped stator mounted within said first chamber so that the cylindrical wall thereof is between said inlet and said apertures in said first stator, apertures through said cylindrical wall, a rotor rotatively mounted within said housing and extending rotatively through said first stator comprising a first bladed rotor part on the first chamber side of said first stator, axially directed edges on said first bladed rotor part in closely spaced shearing relationship with the inlet ends of said apertures in said second stator, a second bladed rotor part on the second chamber side of said first stator, and radially directed edges on said second bladed rotor part in closely spaced shearing relationship with said apertures in said first stator, said apertures in said first and second stator being positioned with respect to each other to direct fluid flow therethrough in different directions, so that rotation of said rotor forces material introduced through said inlet successively through said first and second stators and by cooperation of said edges and apertures, subjects said material to shearing actions in different non-parallel planes.

2. An apparatus according to claim 1 wherein said first stator comprises a flat plate extending substantially perpendicularly to the rotational axis of said rotor.

3. An apparatus according to claim 1 wherein said first and second bladed parts are mounted on a common dirve shaft.

4. An apparatus according to claim 3 wherein said bladed rotor parts are blades formed on opposite sides of a common support driven by said drive shaft.

5. An apparatus according to claim 1 and further comprising a third cylindrical hollow stator mounted within said second chamber with the cylindrical wall thereof between said apertures in said first stator and said outlet, apertures through said cylindrical wall of said third stator, and axially extending blade edges on said second bladed rotor part in closely spaced shearing relationship with said apertures in said third stator.

6. An apparatus according to claim 5 and further comprising a detachable end closure member on one end of the housing having said inlet therein, said second stator is mounted on said end closure member so that said end closure member and second stator may be removed from said housing without disturbing any other stator or the rotor, and said third stator has a radially outwardly directed flange removable from the housing without disturbing the rotor, following removal of the end closure member and second stator.

7. An apparatus according to claim 6 wherein said first stator comprises a radially inwardly directed annular flange on said third stator and is axially apertured.

8. An apparatus as claimed in claim 5 wherein said first and second bladed rotor parts are mounted on a common drive shaft, said second and third cylindrical stators are coaxial with said drive shaft, and the diameter of the cylindrical wall of said third stator is larger than the diameter of the cylindrical wall of said second stator.

9. An apparatus according to claim 2, 3, 4, 1 or 5 and further comprising a detachable end closure member on one end of the housing having said inlet therein, and said second stator is mounted on said end closure member so that said end closure member and second stator may be removed from said housing without disturbing any other stator or the rotor.

* * * * *